US008832891B2

(12) United States Patent
Bringedal et al.

(10) Patent No.: US 8,832,891 B2
(45) Date of Patent: Sep. 16, 2014

(54) CONSTRUCTION OF A FLOATING BRIDGE

(75) Inventors: Torbjorn Bringedal, Kalandseidet (NO); Geir Lasse Kjersem, Bønes (NO)

(73) Assignee: Lund, Mohr & Glever-Enger Marin AS, Bergen (NO)

( * ) Notice: Subject to any disclaimer, the term of this patent is extended or adjusted under 35 U.S.C. 154(b) by 0 days.

(21) Appl. No.: 13/880,758

(22) PCT Filed: Sep. 9, 2011

(86) PCT No.: PCT/NO2011/000244

§ 371 (c)(1),
(2), (4) Date: Oct. 17, 2013

(87) PCT Pub. No.: WO2012/033415

PCT Pub. Date: Mar. 15, 2012

(65) Prior Publication Data

US 2014/0053349 A1 Feb. 27, 2014

(30) Foreign Application Priority Data

Sep. 10, 2010 (NO) ..... 20101273
Mar. 31, 2011 (NO) ..... 20110497

(51) Int. Cl.
*E01D 15/14* (2006.01)

(52) U.S. Cl.
USPC ..... 14/2.6

(58) Field of Classification Search
USPC ..... 14/2.4, 2.6, 31
See application file for complete search history.

(56) References Cited

U.S. PATENT DOCUMENTS

| | | | | | |
|---|---|---|---|---|---|
| 401,765 | A * | 4/1889 | Stewart | 14/29 |
| 423,455 | A * | 3/1890 | Stewart | 14/29 |
| 1,624,325 | A * | 4/1927 | Folino | 14/42 |
| 1,852,338 | A * | 4/1932 | Shaffer | 14/27 |
| 1,934,286 | A * | 11/1933 | Tourchette | 14/27 |
| 2,687,617 | A * | 8/1954 | Newell | 405/221 |
| 4,169,296 | A * | 10/1979 | Wipkink et al. | 14/71.1 |
| 4,297,759 | A * | 11/1981 | Soffge et al. | 14/2.6 |
| 4,918,777 | A * | 4/1990 | Ashley | 14/73 |
| 5,263,217 | A * | 11/1993 | Miglietti | 14/32 |
| 7,200,887 | B1 * | 4/2007 | Powers et al. | 14/27 |
| 7,717,642 | B2 * | 5/2010 | Patten | 404/75 |
| 8,590,085 | B1 * | 11/2013 | Smith | 14/32 |

* cited by examiner

*Primary Examiner* — Gary Hartmann
(74) *Attorney, Agent, or Firm* — Francis C. Hand; Carbella, Byrne, et al

(57) ABSTRACT

A device for a floating bridge 15 which is fastened at two anchorage points on the shore (18) is described and it is characterized in that it comprises at least one passage float (1) which is inserted as a part of a bridge construction for the passage of ships, and it forms a passage channel (200) for ships and also forms a foundation for a carriageway (111) which stretches across the passage channel. The floating bridge (15) is fastened ashore and to each side of the passage float (1) with the help of structure boxes (10, 10').

19 Claims, 9 Drawing Sheets

CONSTRUCTION OF A FLOATING BRIDGE

The present invention relates to a device for a floating bridge that is fastened at two anchoring points on the shore.

In more detail the invention relates to a passage float that can be used to form a passage for ships through floating bridges, such as across wide fjords and ocean areas where ship traffic occur.

With passage float there is meant a construction that can be fitted permanently into a floating bridge construction so that ships can pass by the bridge across a channel which is formed by the passage float, at the same time as the passage float forms a foundation for a carriageway for all forms of passenger traffic, vehicles such as cars, trailers and railways, and which runs across the channel which is formed by the passage float.

According to the invention the passage float is set up to be used at most water depths, from about 5 meters to about 2000 meters depts.

The invention encompasses a floating bridge which, according to a first variant, comprises an upwardly extending column construction with a number of columns that carry a carriageway such that ships can pass under the carriageway, and where the passage float is connected to the other construction parts of the floating bridge so that a continuous, floating bridge between the two anchoring points on land is formed.

The invention also relates to another variant of the passage float where a carriageway construction which spans across the channel, mainly level with the carriageway of the two floating bridge elements that run from/to respective land anchorage points so that the crossing of the channel can be mainly horizontal.

The passage float according to the invention can either be anchored to the ocean bed, or not be anchored to the ocean bed with lines or be fastened to the ocean bed with auger piles or ballast.

The crossing of fjords and lakes with bridges has been a challenge for mankind since time immemorial. Different types of bridges have been developed depending on the span, foundation possibilities and clearing height for sailing, and reference is made to the Norwegian patent NO-113404, U.S. Pat. No. 1,852,338, SE-459.850 and GB-2.135.637.

A particular challenge occurs when larger ships shall be able to pass in connection to the bridge. This has been addressed according to known principles for normal, ground foundation-based bridges in that the bridge is constructed with sufficient clearing for sailing or one applies solutions such as a bascule bridge or swing bridge, if the limited bridge span that these solutions dictate is acceptable.

At very long distances across fjords or lakes, floating bridges can be a very cost effective and safe alternative. Floating bridges have been known for a long time and are operating to-day at several locations throughout the world.

Floating bridges comprise a number of floating elements which support a carriageway or walkway. The floating bridges are anchored on land at both ends. Additionally some of the known floating bridges are anchored sidewise to take up environmental forces from waves, the wind and currents.

However, floating bridges that are built according to known techniques have to a very small extent the possibility to let larger ships pass without one using bottom foundation on shallow grounds close to the shore and building a traditional bridge with a foundation for the passage of ships. According to prior art a ships passage of this kind is dependent on there being an ocean bed which is shallow enough so that the foundation can be made. A bottom-based bridge near the shore, which comes in addition to the floating bridge, must be built on the site and will often result in a costly overall solution. In addition, this type of solution is often unwanted by the ship traffic because captains of larger ships are forced to sail close to the shore with a resulting increased risk for running aground.

Additionally in the crossing of fjords and ocean parts it is often difficulty to find an ocean bed relatively close to the shore that is suitable for the traditional bottom foundation-based bridges, something which according to prior art will make it difficult to use floating bridges in such area if one at the same time shall allow the passage of larger ships.

When bridges is to cross wide fjords or larger sea distances, it is often likely that there will be ship traffic in the same area. As floating bridges built according to prior art will prevent the traffic of ships, this leads to great limitations for the application of floating bridges in such areas.

The environmental forces a floating bridge is subjected to can be considerable, in particular during storms where currents, wind and waves can come sidewise and from the same direction. In addition forces that arise from varying water levels such as high and low tides occur. This can lead to considerable bending forces on the floating bridge close to the shore. Therefore, it is important that it is constructed to minimise environmental influences.

The floating bodies of a floating bridge can be constructed in different ways. It is most common to use floating bodies in concrete or steel that support the carriageway and which are wider than the carriageway to ensure stability. These floating bodies are placed with a calculated mutual distance to ensure the necessary buoyancy and stability for the floating bridge, where one seeks to minimise the effects of the environmental forces on the floating bridge at the same time.

A floating bridge can be made both long and independent of sidewise additional anchorage. An example of a such bridge is the Nordhordland bridge in Norway which is anchored by the two anchorage point on the shore only. The bridge is, with its 1246 meter long carriageway, the longest floating bridge in Europe. For this bridge, passage for ship traffic is provided in that an additional, bottom-based high bridge is constructed near the shore with a sailing clearance height of 32 meters and breadth of about 50 meters.

The carriageway on the Nordhordland bridge is about 16 meters wide. The floating bodies are constructed as barges and made from concrete, where the dimension across the carriageway is equal to 40.0 meters and in the longitudinal direction of the carriageway is equal to 20.5 meters. The free distance between these floating bodies is about 110 meters. In that the floating bodies lie with the longest side across the carriageway the forces from currents on the floating bridge and surface water flows substantially unhindered under the floating bridge.

Half-submersible rigs are used extensively in the offshore industry as exploration and production rigs and can withstand large environmental loads. They are stabilised by columns with a limited waterline area and are particularly suitable in exposed areas, often in combination with a disperse anchorage. The shape of the columns means that the effect of the environmental forces is approximately equal from all-weather directions.

Weather statistics over many years indicate the dominant and likely direction for the environmental forces such as wind, waves and currents. During long term anchorage of floats one will be able to use this information advantageously. A floating bridge can thereby be constructed so that the consequences of the environmental forces are minimised.

It is an aim of the present invention to provide a device which encompasses a floating bridge where at least one of the floating elements is formed as a passage float so that larger ships can pass the bridge through a channel which is defined by the passage float, and where the passage float is made with a number of columns which support the part of the carriageway of the floating bridge that passes the channel and under which ships can pass.

It is also an object to provide a variant where a carriageway across the channel runs horizontally and level with the horizontal carriageway of the floating bridge from the two land based sides of the floating bridge and establishes a continuous horisontal carriageway in the whole length of the floating bridge, as the carriageway can be displaced (by swinging to the side or be floated out of the channel and be parked alongside the bridge) so that ships can pass unimpeded through the channel.

It is also an aim of the present invention that the passage float makes up a suitable construction element of the floating bridge and which is anchored to the other floating bridge elements so that is contributes to make a continuous carriageway along the whole length of the floating bridge.

By floating elements there is in this context included the modules and elements of which the floating bridge is composed, which will typically include float bodies, carriageway, support columns, structure boxes, larger column structures, etc.

By a structural box there is included a box-like reinforcing element which can form the chassis and base for a transport/carriageway. Such box reinforcing elements can be water tight boxes built up around a trussed network construction, or be a trussed framework with a bottom part that is brought onto the floats, and with a carriageway at the top.

Moreover, it is an aim of the invention that the passage float and adjoining floating bridge elements are constructed with sufficient stability when unsullied or damaged so that the consequences for the floating bridge at possible collisions with larger ships are limited.

It is also an object of the present invention that the passage float or the adjacent floating bridge elements can either be unanchored or anchored to the ocean floor, depending upon local environmental conditions and depending upon whether or not the anchoring is to be dimensioned for providing for reduced consequences of potential ship collisions.

When afloat the passage float according to the invention can be anchored with flexible lines, either directly to the passage float, or in that the lines are fastened in connection with one of the neighbouring float elements to the passage float. The anchoring can reduced the effect of the large environmental forces and make the floating bridge in a better state to withstand the forces from ship collisions.

In shallow water the passage float can be fastened directly to the ocean bed according to known techniques such as piling or fixed ballast, whereas the rest of the floating bridge remains afloat.

It is further an object of the invention that the passage float can be formed to a geometry which renders in easy of it to be prefabricated and be built in conventional ship construction docks, beneficially constructed from steel or from concrete.

Furthermore it is an aim of the invention to provide a solution where passage can take place under water in the area of the passage float, in that the passage float can have a construction much like that of a tunnel pipe bridge.

The device according to the invention is characterised in that it comprises at least one passage float which is inserted as a part of the bridge construction for passage of ships and it forms a passage channel for ships and also forms a foundation for a carriageway that spans across the passage channel.

Beneficially, the passage float is implemented as a pontoon with floating functionality and with a substantially U-formed cross-section for forming the canal, in that it includes mutually substantially parallel vertical wall sections which are joined together under the water surface by way of a substantially horizontal bottom structure.

Beneficially, the passage float comprises coupling structures for coupling between the floating bridge's other force- and strength-providing structural boxes, such that there is formed a continuous structure which is suspended together between the two land connections adapted for transferring forces between the structural boxes on both sides of the passage float.

Beneficially, the roadway is implemented permanently over the passage canal at such a height that ships can pass through the canal below the roadway, such that the roadway is supported on support columns which extend up from the vertical wall sections of the passage float.

Beneficially, the substantially horizontal roadway runs along a viaduct which is sloping upwardly to a high bridge portion which passes over the passage float, such that there is formed a continuous roadway along an entire length of the floating bridge.

The canal-crossing roadway is constructed to be reconfigured from a first active useable state wherein it defines a substantially flat roadway running in line with the horizontal roadway of the floating bridge from the two land regions, and to a second state wherein the roadway is rendered free from the passage canal for allowing ships to pass.

The canal-crossing roadway can also be adapted to swing vertically in a manner akin to a swing bridge, or be swung horizontally sideways for rendering the canal free for ship passage therethrough.

The canal-crossing roadway can also form the top surface to a float adapted to be moved within the passage float's canal and be coupled by coupling means to an inside of the vertical wall sections of the passage float, and comprise a roadway section which runs horizontally with the ordinary roadway from each region of land, wherein the floats are allowed to be free from the passage float and can be moved away for rendering the canal free for the passage of ships.

The floating bodies adjacent the passage float can be equipped with anchoring systems with a number of anchoring lines. Furthermore, the structural boxes can be continuous constructions, and is supported by a number of floating bodies and run horizontally at substantially constant height over the ocean surface between the passage float to each of its land attachments.

The coupling structure can beneficially be equipped with a break coupling point which can be deformed or broken in an event of a ship collision against the passage float. In a floating condition, the passage float is provided with anchoring systems with a number of anchoring lines to the ocean floor.

Moreover, the structural boxes can support portions of the roadway by way of support columns. The passage float can also be installed on the ocean floor by way of ballast or piles.

Pursuant to an especially beneficial embodiment, the floating bridge includes at least two mutually distanced inserted passage floats, wherein:

at least one passage float forms a permanent canal-crossing roadway together with at least one reconfigurable canal-crossing roadway.

The last solution envisages that the one and same floating bridge can include both types of canal placement, namely a permanent high-bridge part (variant 1) where normal traffic can pass, and a removable part (variant 2) which is employed only in situations when extra large ships higher than a high-bridge are envisaged to pass. It can also be envisaged to employ several passage floats, namely more than just two passage floats, along the same floating bridge, depending upon traffic demands.

According to an alternative solution, there is provided a construction which makes it possible for a submerged passage for road vehicles, in that the passage float is formed inside with a hollow "tunnel"-section with suitable height and breadth. This is achieved by a roadway being brought down to a slope and through into one of the two wall sections, flattening out within the horizontal hollow submerged horizontal part for thereafter running along a slope upwardly again through the opposite vertical wall section.

Beneficially, the two floating elements and the coupling structures, which on both sides support abut the passage float, are formed with a sloping construction for the roadway box which runs in towards the roadway integrated in the passage float, and with the horizontal roadway on top of the structural boxes toward land on both sides.

The passage float can, of course, comprise a floating bridge element, a passage float, which is incorporated into a floating bridge and which is formed with two, beneficially parallel vertical walls sections which are partially submerged into the sea, wherein the wall sections in the bottom are coupled together via a bottom structure and wherein the wall sections are mounted to a number of upwardly orientated columns which support a portion of the total roadway of the float bridge.

The two parallel wall sections pursuant to the invention support the roadway which is to cross the canal, and ensures in floating condition for the necessary buoyancy and stability for the passage float, both with normal operation, with strong storms and in an event of damage of the passage float. The two parallel wall sections are arranged with a mutual separation, such that they define the aforementioned canal, such that ships can pass between the wall sections and under the roadway (in the first variant (1)) in a direction across the length direction of the floating bridge.

In the second variant (2), the roadway is moved/swung to the side, such that the ship can pass through the canal unhindered by the height of the bridge superstructure.

The distance between the two wall sections in the passage float is determined by the breadth of the ships which are to pass through the passage float. For smaller ships, the requirement for sailing width is typically in a range of 50 meters to 60 meters, but it is possible pursuant to the present invention to have a sailing with of above 200 meters for accommodating the largest ships which are constructed in the World, at the same time as providing a considerable safety distance between the passing ship and the wall sections of the passage float.

For allowing smaller ships with breadth of up to 15 meters to 20 meters and sailing height of 40 meters, each of the two wall sections can have dimensions in a breadth direction of the roadway of approximately 50 meters and in a length direction of the roadway of approximately 25 meters.

For allowing the largest ships to pass, with a sailing width of, for example, 250 meters, such as large cruise ships with a breadth of 40 meters and a length of 280 meters, there will arise a need for increased dimensions for the two wall sections, typically of approximately 110 meters in a breadth direction of the roadway and of approximately 30 meters in a length direction of the roadway.

The bottom structure binds together the two wall sections to form a U-structure, and this U-structure is dimensioned pursuant to known principles for taking up forces which are transferred to and from the remainder of the floating bridge. The bottom structure will lie deep enough such that a desired ship can pass over it, and at the same time that there is ensured a satisfactorily structurally stiffness in the whole of the passage float. The position for the upper part of the bottom structure defines the sailing depth. For smaller ships, there is required a sailing depth of approximately 5 meters to 8 meters, whereas for a larger cruise ship, there is normally required a sailing depth of minimally 13 meters to 15 meters. Depending upon needs for dimensioning, the vertical thickness of the bottom section will need to be approximately 4 meters to 10 meters.

It will be appreciated that the passage float pursuant to the present invention has the form of a U-shaped pontoon, with the same cross-sectional form, for example, as a dry dock which comprises a bottom section and vertical wall sections.

It is also possible to dimension up the passage float further for allowing large tank- or bulk-ships to pass. The largest known ships of this type have a floating depth of 25 meters and a ship breadth of circa 65 meters, and will require large depths and distance between the wall sections of the passage float. The advantage provided by the present invention is that the passage float pursuant to the present invention can be positioned in a middle of the fairway for these large ships, a long distance from land, such that a need for manoeuvring the ships is reduced.

The sailing height under the roadway, as for the first variant, on the passage float is dependent upon height of the columns which are mounted onto the parallel wall section. The sailing height is typically 20 meters to 30 meters for smaller trading ships to over 70 meters for allowing the highest passenger ships to pass under the roadway. The columns and associated support to the roadway are implemented and dimensioned pursuant to known principles. For the inventive solution with the second variant, there is no height restrictions on account of roadway which crosses the canal being swung to sides (or upwards).

The roadway in the remainder of the floating bridge away from the passage float is supported pursuant to known techniques for mutually-coupled box structures which are attached to land.

These box constructions are attached pursuant to the invention to the passage float. In addition, the roadway, which runs over the passage float's canal, is coupled together with the roadway of the remainder of the floating bridge.

A floating bridge can alternatively comprise several passage floats, beneficially placed and installed with a chosen mutually separation along the floating bridge, for example with one-way shipping traffic through the two passage floats. This is relevant when there is considerable shipping traffic which must pass through the bridge.

Beneficially, the structural boxes are coupled from a remainder of the floating bridge directly to the passage float in a most symmetrically possible manner towards a middle of each wall section, such that a major portion of the forces which arise in a length direction of the floating bridge are transferred through the structural boxes and the U-structure (wall sections and bottom section), such that there is formed a continuous transfer of forces through an entire length of the bridge.

A majority of the force transfer in the floating bridge's length direction can thereby occur horizontally just over the water surface, only disrupted by the aforementioned U-formed passage float which is dimensioned for transferring these forces under water via the horizontal bottom section.

The floating bridge can be implemented pursuant to known principles in a curvature or straight line, depending upon the local environmental conditions and locality of the attachment points to land.

The wall sections in the passage float can be designed in different ways according to known principles. The wall sections can be formed such that substantially the whole canal-forming hull for optimally being able to cope with forces which arise when attaching the floating bridge's structural boxes to the wall sections. Alternatively, the passage float is implemented as a column-stabilized structure with vertical floating columns, for example as a half-submerged oil rig, namely something which will be advantageous in regions with large wave exposure.

The structural boxes can, according to known principles, be implemented either as complete planar structures or as truss structures. The structural boxes can be attached in the wall sections either with help of welding or pursuant to known mechanical coupling arrangements, such as bolting or binding cables.

It is an advantage that the passage float pursuant to the present invention can be placed anywhere along the floating bridge's length direction. This can be in a middle position of the floating bridge, or closer to land on one side of the bridge.

The floating bridge can, if desired, be implemented with anchoring, depending on topography, water depth and environmental considerations. The passage float can, if desired, be anchored directly to the ocean floor.

It will however be especially advantageous when the anchoring lines are fastened to the nearest neighbouring floating bodies to the passage float, preferably without the passage float itself being anchored. This combination can give increased safety in an event of a ship collision against the passage float, on account of the anchoring being dimensioned to take up forces from such a collision. In such a situation, the structural boxes nearest the passage float are implemented as a coupling structure, beneficially with specially implemented break coupling points (weak link), which yield in an event of a ship collision against the passage float, beneficially be completely broken away. Thereby, the passage float can be implemented such that it is deformed or is ripped away at the break coupling points from a remainder of the floating bridge in an event of such an accident, whereas a remainder of the floating bridge remains mostly unaffected. This requires that the floating bodies for the remainder of the floating bridge are dimensioned for floating independently of the passage float at the same time the passage float beneficially has satisfactory stability also for coping with such damage.

A need for anchoring of the floating bridge pursuant to the present invention can be advantageously achieved in case of an especially long span of the floating bridge, for example over 2 km to 3 km, and in such cases where the anchoring can contribute to reduce the consequences of a potential ship collision.

In shallower water the passage float can alternatively be fastened directly to the ocean floor. This can be achieved by towing out the passage float to the installation site and then sinking it towards the ocean floor, whereafter it is secured according to known techniques with use of piling or by use of permanent ballast.

In deeper waters, there can be utilized a tight or partially tight line anchoring for the floating passage float. In especially deep water, it is envisaged that it is advantageous to utilize a number of tight anchoring lines fabricated from polymeric materials, such as polyethylene, Kevlar, and so forth. These have an advantage that they weigh little, are strong, are economical in cost, and can be used in deep water and result in little horizontal movement.

Computations have shown that a passage float pursuant to the present invention can provide extremely good movement characteristics when the floating bridge in deployed in water ways which are completely or partially shielded from larger ocean waves and swells. When implementing the passage float, one can, pursuant to known techniques, take into consideration local wave conditions such as roll, pitch and heave. Thereby, the passage float can be implemented such that it undergoes minimal movement and thereby is able to provide a very stable foundation for the roadway, with at least as small movement as experienced for a suspension bridge.

The roadway in the floating bridge's length direction (variant 1—high bridge passing the canal) will have constant gradient until it reaches the top over the passage float. For example, a gradient of 1:5 results in the roadway having a height which changes by 5 meters for each 100 meters of roadway.

The sloping roadway away from the passage float can be stiffened pursuant to known techniques in the form of a viaduct via use of the structural boxes, columns and diagonal stiffening members (crossbeams).

An arrangement pursuant to the present invention will be elucidated in more detail in the following description with reference to the appended drawings, wherein.

Figure 10:
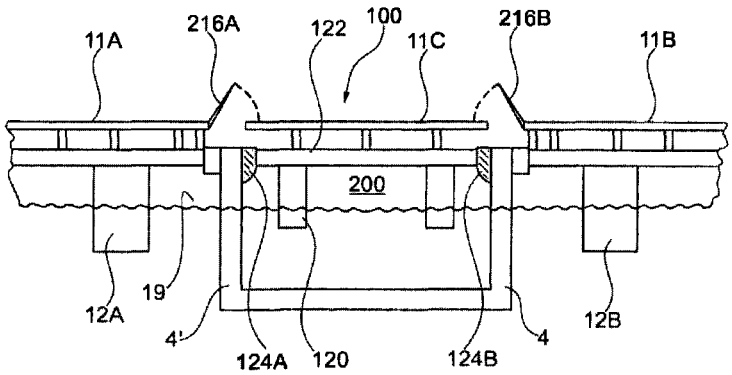
Figure 11:
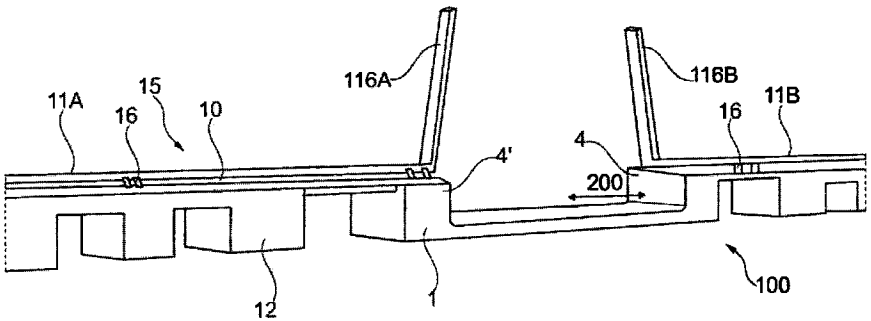
Figure 12:
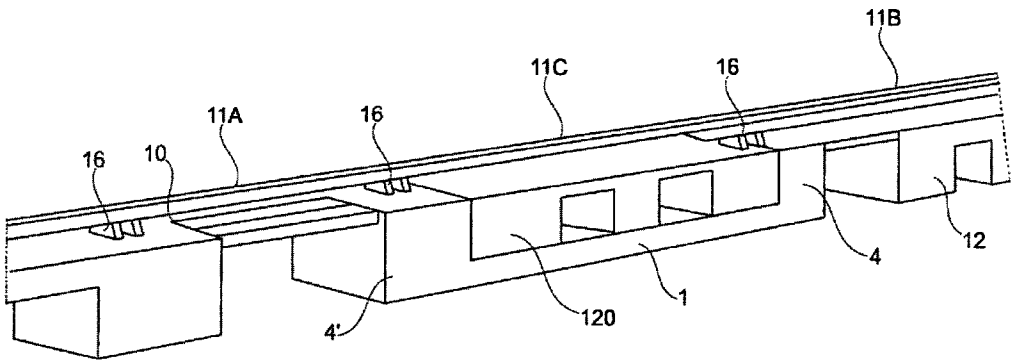
Figure 13:
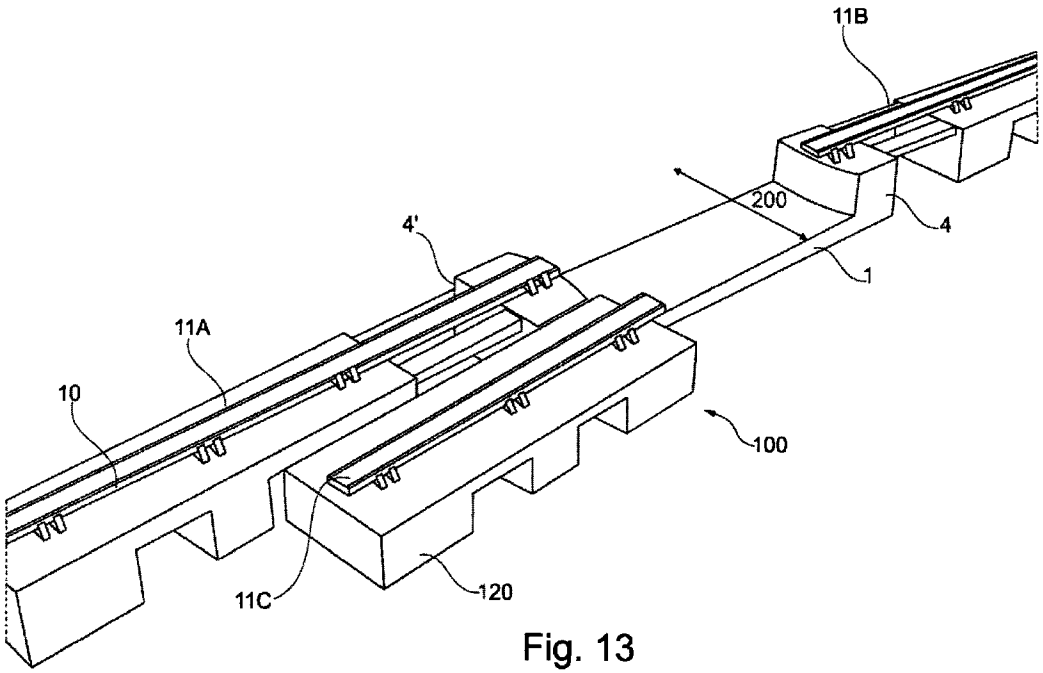

FIG. 10 is an illustration also in vertical cross-section view, wherein the roadway is built onto a top surface of a float 100 adapted to float within the passage float's canal (U-form) and which comprises a roadway section 111 which runs substantially horizontally in respect of the ordinary roadway 11A, 11B from each side, and which can be moved away from the canal through the passage float when a ship is to pass;

FIGS. 11-13 are illustrations of a practical implementation of the solution where there is provided a flat substantially horizontal roadway along the entire floating bridge, and illustrates the two manners of forming the roadway over the canal of a passage floats roadway 1 floats 200;

Similar parts of the drawings details are given the same reference numbers on the different diagrams.

The whole floating bridge 15 is constructed by coupling together several floating bridge elements in the form of modules in appropriate lengths, breadths and general form. Each floating bridge element can typically include floating bodies 12, 22, coupling structures 24, sections of roadway 11, sections of support structure such as structural boxes 10, support columns 13, a number of passage floats 1, and so forth. The different floating bridge elements of the floating bridge 15 will most advantageously be couplable together pursuant to known techniques for prefabricated units, wherein coupling up and securing of the floating bridge elements to a major extent can occur in a floating state.

Figure 1:
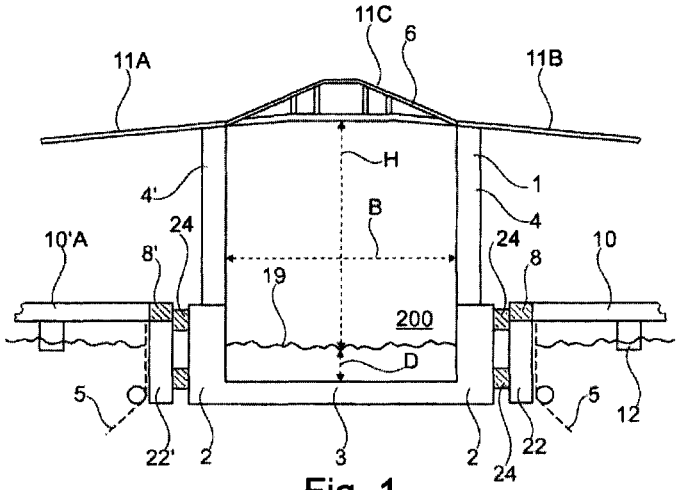
FIG. 1 is an illustration of a vertical cross-section in a direction along the roadway of the arrangement with passage float.
Figure 2:
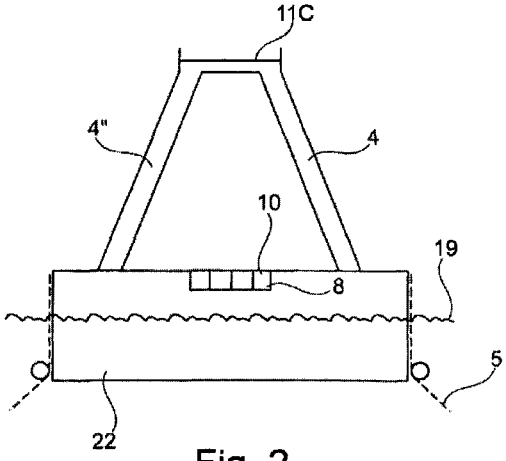
FIG. 2 is an illustration in vertical cross-section of the roadway of an arrangement including a passage float.

In FIG. 1 and FIG. 2, the passage float 1 pursuant to the invention is shown as a U-shaped pontoon construction comprising two vertical wall section 2, 2' which are mutually coupled together with a box-form bottom structure 3 adapted to lie under the water surface 19 and with supporting columns 4, 4', 4" which are mutually coupled together on the top with a overlaying support- and stiffening-structure 6 which stiffens the roadway 11 and a remainder of the passage float 1. The passage float 1 is attached according to known techniques to the nearest floating bodies 22, 22' with help of well known adapted coupling elements 24, 24'. It can for example comprise permanent fasteners or detachable couplings which will be well known to a person skilled in the technical art.

The coupling elements 24, 24' can be formed according to requirements, such as including welded plate components, pipes, mechanical equipments, pipe structures and similar, depending upon the forces which will be experienced by the coupling structure 24. The coupling structure 24 can, if desired, be formed with a break coupling point (not shown) which can be deformed or broken in an event of larger ship collisions against the passage float 1, such that the passage float 1 subsequently can be pulled free from a remainder of the floating bridge 15. This will limit transfer of collision forces from the passage float 1 to the remainder of the floating bridge 15. This will require that the floating body 22 nearest to the passage float 1 is dimensioned to float in a stable manner after such a collision without connection to the passage float 1, such that this floating body 22 together with the other floating elements 12 ensure that the remainder of the floating bridge 15 continues to float in a most undamaged state.

On account of the coupling structures 24, 24' being dimensioned for being deformed or broken from a remainder of the floating bridge 15 in an event of a ship collision against the passage float 1, it is envisaged to be advantageous that the nearest floating structures 22 be equipped with anchoring. The anchoring system, with lines 5 which are positioned on the nearest floating bodies 22, can be dimensioned to take up a considerable portion of the forces which arise in an event of a ship collision against the passage float 1.

The depth from the ocean surface 19 down to the top of the bottom structure 1 is shown with a sailing depth D. The sailing depth D for smaller ships is in a range of 5 meters to 10 meters, whereas for larger ships the depth D ought to be in a range of circa 13 meters to 15 meters. For the largest ships, the sailing depth according to known techniques can, if desired, be increased considerably.

The sailing breadth B depends on the breadth of the ships which are required to pass the floating bridge 15 in addition to necessary safety distance to the hull sections 2, 2'. A typical sailing breadth with safety margins is in a range of 40 to 50 meters for small ships and over 200 meters when larger ships shall pass.

The sailing height H is shown in FIG. 1 as a distance from the water surface and up to the underside of the roadway 11 with the associated support- and stiffening-structure 6. The sailing height H with necessary safety margin is typically in a range of 20 to 30 meters for smaller trading ships and up to nearly 80 meters, for example, for the very largest cruise ships.

Figure 2A:
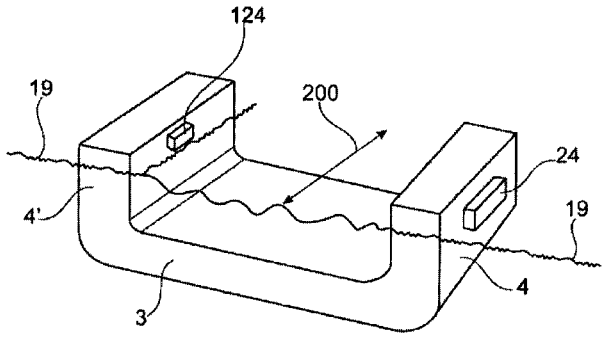
FIG. 2A is an illustration in perspective view of the pontoon-formed passage float.

FIG. 2A is an illustration in perspective view of the pontoon passage float, which can be employed in both variants of the present invention. There is shown the vertical upright wall sections 4 and 4', and the horizontal bottom section 3. Moreover, the wall sections and the bottom section can be a truss-frame construction, and wherein there is built in a necessary floating arrangement in a form of float elements.

Figure 3:
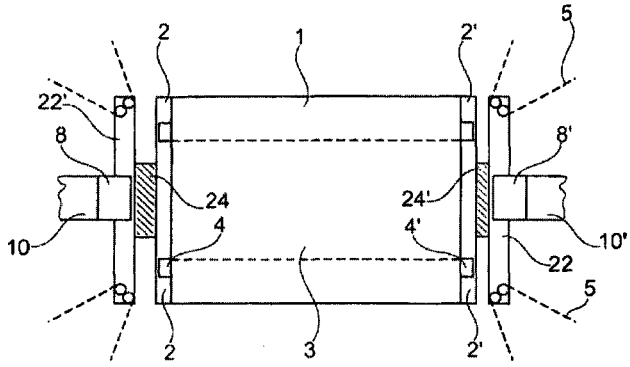
FIG. 3 is an illustration in horizontal cross-section of an arrangement with a passage float.

FIG. 3 is an illustration in horizontal cross-section of the passage float 1 with the two vertical wall sections 2, 2' whose top surface forms a foundation for the upright support columns 4, 4'. The structural boxes 10, 10' form the upper part of the floating bridge 15 towards the respective land connection points, and are attached to the wall sections 2, 2' via coupling structures 24, 24', most preferably symmetrically around a mid-region of the respective wall sections 2, 2'.

The floating bridge elements 10, 10', 8, 8' are advantageously disposed over the water surface 19, and in addition over wave top heights which may arise, such that environmental forces on the floating bridge 15 are rendered minimal.

Figure 4:
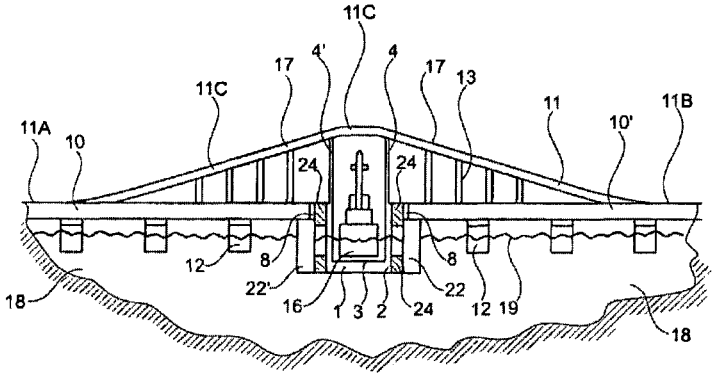
FIG. 4 is an illustration in vertical cross-section along the roadway of a floating bridge which includes an arrangement with a passage float.

The whole floating bridge is shown in FIG. 4, wherein the structural boxes 10, 10', which the roadway 11 rests upon, are disposed at a substantially constant height over the water surface 19 by floating on top of floating bodies 12, 22, 22'. The structural boxes 10, 10' are fastened according to known techniques to land 18 and are in addition shown fastened to the nearest floating bodies 22, 22' at attachment points 8, 8'. These nearest floating bodies 22, 22' are shown attached to the passage float 1 with help of the coupling structures 24, 24'.

Attachment to the attachment points 8, 8' can be implemented with help of welding, attachment cables, bolts, and so forth, which ensure both necessary transfer of forces and flexibility for coping with the forces and movement which the floating bridge experiences when in operation.

The whole floating bridge 15 between the two bridge attachment points to land 18 can be designed and formed by using known computing techniques. An advantage with the present invention is that the bridge's movement, and a majority of the forces, are transferred to the floating bridge's 15 length direction as predominantly horizontal forces through the structural boxes 10, 10' and the coupling structures 24, 24', and are thereafter further transferred to the U-structure 2, 3, 2' which is formed between the hull sections 2, 2' and the bottom structure 3.

It is important that the floating bridge 15 according to known techniques is formed such that these large horizontal forces are transferred through the structural boxes 10, 10' and U-structure 2, 3, 2' and as little as possible of these forces are transferred directly through the support- and stiffening-structure 6, through the viaduct 17, through the support columns 13, and the remaining structure for the roadway 11. Thereby, it is possible to limit the horizontal forces which arise in the upper portion of the passage float 1 and roadway 11.

The passage float 1, or the nearest floating bodies 22, 22', can according to requirements be anchored pursuant to known techniques using an anchoring system comprising anchor lines 5 and winches (not shown).

Figure 5:
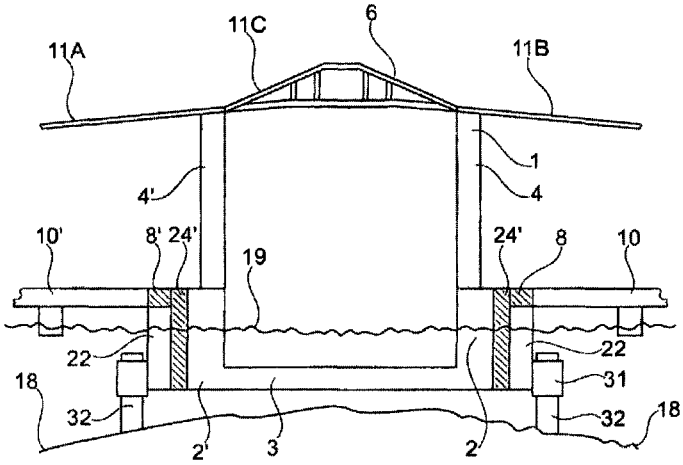
FIG. 5 is an illustration in vertical cross-section in a direction along the roadway of an arrangement with a passage float which is piled into the ocean floor.

In shallower water, the passage float 1 can be fastened to the ocean floor 18 as shown in FIG. 5 with help of piles 32 which are secured in guide tubes 31 which are attached to an outer side of the passage float 1. The rest of the floating bridge 15 can, pursuant to the present invention, be formed according to the same principles as for when the passage float 1 were floating.

Figure 6:
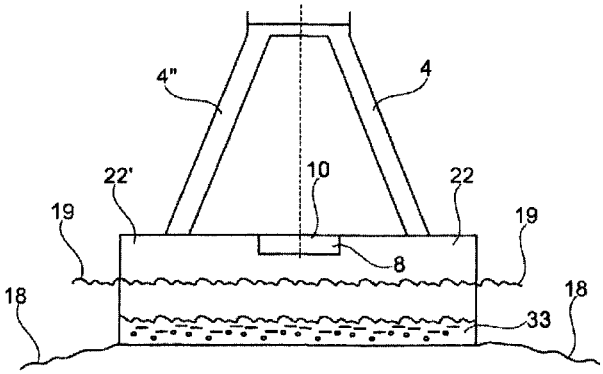
FIG. 6 is an illustration in vertical cross-section of the roadway of an arrangement with a passage float which is installed onto the ocean floor by employing ballast.

Alternatively, the passage float 1 can in green water (shallower water) be installed by being set down and resting on the ocean floor 18 as illustrated in FIG. 6. This can be implemented according to known techniques with help of ballast 33 within the passage float's 1 hollow room, for example in a form of stones, iron ore or as liquid ballast in the form of sea water. The rest of the floating bridge 15 can be formed according to similar principles which are otherwise described.

The coupling structures 24, 24' are shown in FIG. 5 as an all-welded structure between the wall sections 2, 2' and the nearest floating bodies 22, 22', such that it forms a fully integrated construction between the wall sections 2, 2' and these floating bodies 22, 22'. This can be done also when the passage float 1 floats.

The advantage with positioning a passage float 1 on the ocean floor as one of several floating bridge elements instead of building a conventional bridge with foundations in green sea regions (shallower sea regions) is that the whole passage float 1 can be prefabricated more economically in docks and thereafter be towed to an installation site, whereat the passage float can be installed in a duration of a few days.

Figure 7:
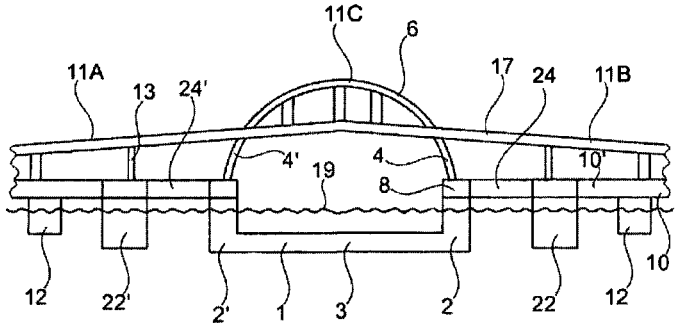
FIG. 7 is an illustration in vertical cross-section in a direction along the roadway of an arrangement with a passage float adapted to reduce the consequences of a ship collision.
Figure 8:
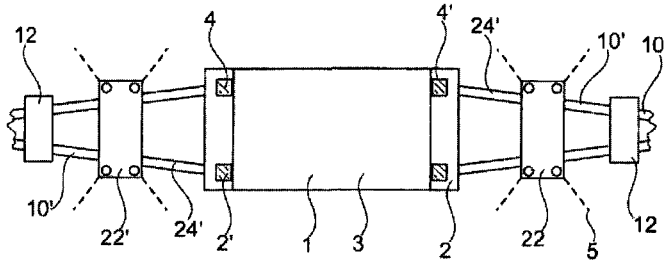
FIG. 8 is an illustration in horizontal cross-section of an arrangement with a passage float adapted to reduce the consequences of a ship collision.

FIG. 7 and FIG. 8 are illustrations of a floating bridge with a greater sailing breadth, preferably over 200 meters, and wherein the coupling structures 24, 24' have a length which can be near the distance between the floating bridge's other floating bodies 12.

FIG. 8 is an illustration of the coupling structures 24, 24' which, if desired, can be implemented as truss structures, preferably in a diagonal angle (out to sides) in relation to the bridge's main length direction. This will according to known methods improve the distribution of forces through the coupling structures 24, 24'. The coupling structures 24, 24' can, according to known techniques, be provided with a break coupling point (not shown) for limiting damage in an event of a potential ship collision with the passage float 1.

The break coupling points can be welded, mechanically or otherwise coupled, and are implemented pursuant to known techniques to deform or be broken in a given region when forces applied thereto exceed given threshold values. On account the floating bridge 15 being equipped with break coupling points in connection with the coupling structures 4, corresponding break coupling points are beneficially implemented in association with the structures around the roadway 11 and the viaduct 17.

The nearest floating bodies 22, 22' are shown anchored to the ocean floor by way of anchoring lines 5, whereas the passage float 1 is shown without anchoring lines. With this implementation, the consequences of a ship collision against the passage float 1, and by employing known computational techniques, can be limited to only include that the passage float 1 with its coupling structures 24, 24', wherein these are implemented to be deformed or damaged at the break coupling points. This requires simultaneously that the passage float 1 and the nearest floating bodies 22 are implemented to give satisfactory damage stability after such a collision.

The attachment between the viaduct 17 and the other parts of the passage float 1 is implemented such that they form a continuous roadway 11 along the whole length of the floating bridge 15. This is achieved using known techniques, such as welding, bolting, riveting, tension-cables and so forth.

The roadway 11 is shown in FIG. 4 (variant 1) running from land 18 to a given length directly on the upper side of the structural boxes 10, 10' for continuing thereafter at a slope up to the viaduct 17 which is supported by way of columns 13, wherein the columns 13 are provided with foundations on the structural boxes 10, 10'. After the viaduct 17, the roadway 11 continues over the floating passage float 1 and thereafter the roadway 11 continues downwards through the viaduct 17 on the other side. The gradient of the viaduct 17 can typically be in a range of 1:5 to 1:6, depending upon local conditions and requirements.

Fabrication of the U-formed pontoon-like passage float 1 is implemented most appropriately as an integrated unit, beneficially in a dock, which is finally floated out to an installation site and is attached to a remainder of the floating bridge 15, namely between the two floating bridge elements which run into each corresponding land attachment point.

An advantage provided by the present invention is that attachment of the structural boxes 10, 10' to the passage float 1 is unaffected by tidal water changes. This can result in reduced tension at attachment points compared with the floating bridge's attachment to the land 18, wherein tidal water differences will result in varying tension in the floating bridge's 15 nearby structures.

Beneficially, it is preferred that the two wall sections 2, 2' are implemented to be as most parallel as possible in a direction of the canal 200 for the ships, such that the mutual separation between the two wall sections 2, 2' remains substantially the same along its entire length.

FIG. 4 is an illustration of a ship 16 which passes through the passage float 1 via the sailing passage 200 between the wall section 2, 2'. The bottom structure 3 is positioned as deeply as practically possible for ensuring a largest possible sailing depth D, simultaneously with addressing the need for transfer of forces in the whole floating bridge's 15 length direction by way of the wall sections respectively being attached to structural boxes 10, 10' on each side. The bottom section 3 can be formed as a watertight plate structure or as a truss construction and dimensioned pursuant to known principles.

The structural boxes 10,10' can also be implemented according to requirements, either as a complete or partially closed plate structure or as a truss construction of desired length.

An additional advantage of the present invention is to employ the passage float 1 as a lifting apparatus in the completion of construction of the floating bridge 15. This can be achieved by equipping the support- and stiffening-structure 6 with lifting apparatus, for example such as winches (not shown) or transverse cranes, which have as a consequence that the floating bridge elements can be lifted up over the water surface for being coupled together pursuant to known techniques. The ship passage through the canal between the wall sections 2, 2' is in its construction phase well adapted to be employed as an assembly area for the floating bridge 15, whereat floating bridge elements are moved into this ship passage for further attachment together with help of installed lifting apparatus. The floating bridge elements which are to included in the floating bridge 15, such as the structural boxes 10, 10', the support columns 13, the roadway 11, and so forth, can in this advantageous manner be lifted up and mounted together in this ship passage. During the construction period, the passage float 1 can be temporarily anchored near land.

The security of the floating bridge 15 can be increased further by installing instrumentation which during use provides warnings of ships on an incorrect trajectory, for example by employing radar. In an event of a ship being on an incorrect trajectory in relation to the ship passage in the passage float 1, the bridge 15 can be closed automatically, especially in a region around the passage float 1, such that no automobiles or other traffic are to be found on the roadway near to the passage float 1 in an event of ship collision.

In the foregoing, FIG. 1 to FIG. 8 have been described in respect of a first variant of the present invention, wherein the roadway 11 spans over the ship canal 200 through the passage float 1, wherein there is provided a viaduct construction high above the ocean surface 19. This height limits how large and high ships can be which pass "through" the floating bridge 15.

A second variant of the present invention (see FIG. 9 and FIG. 10) is based upon the roadway section passing by the canal can be moved, such that the canal is opened completely such that there is no height limits for passing ships. There is thereby achieved, moreover, that the roadway over the canal can be laid completely flat when moved, with the roadway running on each side of the floating bridge and in towards land.

Figure 9:
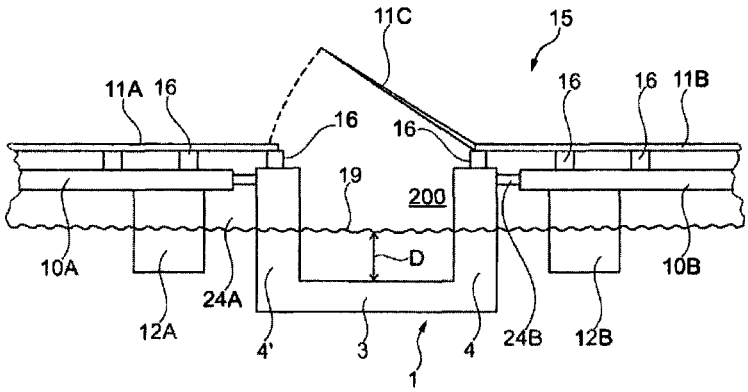
FIG. 9 is an illustration in vertical cross-section in a direction along the roadway of an arrangement with a passage float, and wherein the roadway which spans over the U-formed passage float is a swing bridge.

According to the invention, this can be implemented in two ways, wherein the first way is shown in FIG. 9 which is an illustration of the floating bridge floats 12A and 12B with strengthening boxes 10A and 10B along their length onto which the roadway 11A to 11B is laid via short columns 16. The two roadways 11A, 11B from each side run substantially horizontally to the passage float 1 which is mounted between the strengthening boxes via coupling elements 24A, 24B corresponding to those of the aforementioned examples. On the top of one vertical wall section 4 of the passage float 1, there is mounted one end of a swing bridge 116 with corresponding swing pivot and driving arrangement for swinging the bridge plate 116 between its active useable state as a roadway wherein it runs with the roadway 11A, 11B, and a raised vertical state which opens the canal 200 in the passage float 1 for free passage of ships.

Pursuant to a second variant, as shown in FIG. 10, the roadway elements for spanning over the canal are mounted to the floating element 100 which is adapted to float within the canal 200 and form a roadway 111 which connects in a running manner with the floating bridge roadway, namely there is formed a continuous horizontal roadway. The floating elements 100 comprise pontoons 120 and a horizontally overlying deck plate 122, and a roadway 111 which is adapted to be disposed running with the roadway 11A, 11B.

This solution can be relevant in situations where there seldom pass ships. The floating elements 100 are secured firmly against the inside of the vertical wall sections in the passage floats 1 with help of coupling elements 24A, 24B, such that they and the roadway 111 are held in correct running position to the roadway 11A, 11B. From the end edges of the roadway elements 11A, respectively 11B, there is mounted pivotable swing members 216A respectively 216B which can be swung down for forming a suspended roadway 11A, 111, 11B. In an event that a ship is to pass, the members 216 are swung up, and coupling elements are arranged for rendering free of items attached against inner walls of the passage float 1, and the floating bodies are towed out of the canal, so that the ship can pass. For this purpose, the floating elements can be provided with their own motor propulsion such that they can individually manoeuvred out of the canal 200. Alternatively, the floating bodies can be coupled to a system which glides along a rail system, whereby the floating bodies can be pushed out and swung to a side.

FIG. 11 is an illustration with the passage float 1 secured in a floating bridge 15. The roadway over the canal 200 is formed by two swing members 116A, 116B which are swung up for passage of ships through the canal 200.

FIG. 12 is an illustration wherein a removable roadway float 100 is analogous to the version in FIG. 10 and is arranged in between the wall sections 4' respectively 4 in the passage float 1 for forming a flat horizontal roadway 11A, 111, 11B over the canal 200.

FIG. 13 is an illustration similar to FIG. 12, but wherein the roadway floats are moved (by towing) out of the canal and laid in towards the flat floating bridge parts, in that the canal 200 is open for ship traffic therethrough, without height limitations. In FIGS. 12 and 13, there is utilized corresponding reference numbers as in FIG. 10.

One side of the float 100 can pursuant to a non-limiting example be envisaged to be pushed along a correspondingly formed wheel guide/rails in the wall of the float respectively inside of the passage float 1 wall section, and be swung in to the side of the floating bridge as shown in FIG. 13 with help of a hinge construction (not shown).

Pursuant to an alternative manner, passage of ships can occur by way of a construction which makes it possible for submerged passage of vehicles. This requires that the passage float 1 can be implemented inside with a hollow "tunnel"-section with appropriate height and breadth. The roadway can correspondingly be sloping down through and into the first of the two wall sections 2 (FIG. 1), flatten out inside between the horizontal submerged horizontal bottom section 2. In order that the roadway will not be large and have a steep slope, the two floating bodies 12, 22 and the coupling structures 24, which from each side support against the passage float 1, are implemented with a sloping-constructed roadway-box which runs with the horizontal roadway up onto the structural boxes towards land on both sides. In this manner, the strength of the construction is maintained.

CONCLUSION

There is provided a solution with a U-shaped passage float 1 which can form an inserted canal in a floating bridge and through which ships can pass (without reducing the composite bridge's strength). A roadway, which can be implemented in different forms, can be added to span over the canal in different implementations and form a continuous roadway along the entire floating bridge. Alternatively, the roadway can pass through the passage float, namely via a submerged path.

A principal point with the solution is that the passage float 1 is formed such that when it is coupled between the structural boxes 10, the strength characteristics of the floating bridge 15 are maintained with all types of stresses caused by weather, namely without weakening the strength of the bridge construction which comprises the structural boxes and the inserted passage float.

The invention claimed is:

1. Floating bridge for fastening to two anchoring points on a shore including at least one passage section forming a passage channel for ships and a foundation for a carriageway across the passage channel, characterised in that said passage section is a passage float constituting a part of the bridge construction, having an approximate U-shaped cross section for the formation of said channel, and is fastened between power and strength-absorbing structure boxes of the floating bridge so that a joined structure is formed between the two anchoring points on the shore wherein a major portion of the forces which arise in a length direction of the floating bridge are transferred through said structural boxes and said U-shaped passage section such that there is formed a continuous transfer of forces through the entire length of the floating bridge.

2. Floating bridge according to claim 1 characterised in that said U-shaped passage section comprises mutually approximately parallel vertical wall sections and a horizontal bottom structure for positioning below the surface of a water channel.

3. Floating bridge according to claim 2 characterised in that a plurality of support columns on said vertical wall sections support said carriageway permanently above said U-shaped passage section for passage of a ship thereunder at such a height that ships can pass underneath through said channel of said U-shaped passage section.

4. Floating bridge according to claim 3 characterised in that said carriageway runs on a viaduct that inclines upwards to a high part of the bridge that passes over the U-shaped passage section to form a continuous road surface along the whole length of the floating bridge.

5. Floating bridge according to claim 1 characterised in that said U-shaped passage section includes a horizontal roadway for connecting to and between a pair of horizontal roadways extending from said anchoring points, said U-shaped passage section being movable between a first active position with said horizontal roadway being connected to said pair of horizontal roadways and a second position out of the path of a ship passing between said pair of horizontal roadways.

6. Floating bridge according to claim 5 characterised in that said U-shaped passage section is pivotally mounted to swing vertically between said first active position and said second position.

7. Floating bridge according to claim 5 characterised in that said U-shaped passage section is pivotally mounted to swing horizontally between said first active position and said second position.

8. Floating bridge according to claim 5 characterised in that said U-shaped passage section is floatable from first active position to said second position.

9. Floating bridge according to claim 1 further characterised in that said structure boxes are floating elements disposed to opposite ends of said U-shaped passage section and having anchoring lines fitted thereto for anchorage of said floating elements in place.

10. Floating bridge according to claim 1 characterised in that said structure boxes are continuous structures and are supported by a number of floating elements and run horizontally at an approximately constant height above the surface of the water between the passage float of every land anchoring point.

11. Floating bridge according to claim 1 characterised in having coupling structures connecting said U-shaped passage section to said structure boxes, wherein said coupling structures have a coupling breaking point that can be deformed or be broken upon a collision of a ship with said U-shaped passage section.

12. Floating bridge according to claim 1 characterised in that said U-shaped passage section has anchorage systems with a number of anchorage lines for anchoring said U-shaped passage section to an ocean bed.

13. Floating bridge according to claim 1 characterised in that a plurality of support columns on said structure boxes support said carriageway above said structure boxes.

14. Floating bridge according to claim 1 characterised in that said U-shaped passage section contains ballast.

15. Floating bridge according to claim 1 characterised in that auger piles support said U-shaped passage section on an ocean bed.

16. Floating bridge according to claim 1 characterised in that that a plurality of support columns on said U-shaped passage section support said carriageway permanently above said U-shaped passage section and further characterized in having a second U-shaped passage section being movable between a first active position connected between a pair of horizontal roadways and a second position out of the path of a ship passing between said pair of horizontal roadways.

17. Floating bridge according to claim 1 characterised in that said U-shaped passage construction has an internally disposed hollow tunnel section for underwater passage of vehicles.

18. Floating bridge according to claim 17 characterised in that a carriageway inclines down through and into said hollow tunnel section from each end thereof.

19. Floating bridge according to claim 18 characterised in having a carriageway box constructed at an angle and which runs level with said hollow tunnel section and with a horizontal carriageway on top of said structure boxes towards land on both sides.

* * * * *